United States Patent [19]

Patton

[11] 3,961,156

[45] June 1, 1976

[54] COMBINATION TEMPERATURE AND PRESSURE RELIEF VALVE WITH ENERGY CUTOFF SWITCH

[76] Inventor: Thayer E. Patton, 223 Raintree Lane, Chattanooga, Tenn. 37421

[22] Filed: Mar. 24, 1975

[21] Appl. No.: 561,067

Related U.S. Application Data

[63] Continuation-in-part of Ser. No. 478,901, June 13, 1974, Pat. No. 3,873,808.

[52] U.S. Cl. ..... 219/331; 122/504; 219/328; 236/21 B

[51] Int. Cl.[2] ..... F24H 1/00

[58] Field of Search ..... 219/327, 328, 331, 332, 219/512; 122/504; 236/21 R, 21 B, 92 R

[56] References Cited

UNITED STATES PATENTS

| | | | |
|---|---|---|---|
| 1,694,492 | 12/1928 | Tabler | 122/504 X |
| 1,958,660 | 5/1934 | Frazer | 219/332 |
| 2,044,611 | 6/1936 | Hodges | 219/331 |
| 3,154,248 | 10/1964 | Fulton et al. | 122/504 X |
| 3,716,188 | 2/1973 | Shulz | 219/332 X |

*Primary Examiner*—C. L. Albritton

[57] ABSTRACT

A device for limiting the temperature and pressure of a fluid by controlling the electric current to a heating element. The device includes a cylinder connected with a tank in which the fluid is heated and includes a pressure responsive piston movable within a cylinder against a compression spring opposing movement of the piston. The piston is tapered to a conical or somewhat pointed shape at its lower end to allow a faster escape of fluid from the tank and to guide the piston into an opening in the tank to achieve a thorough seal when the pressure in the tank has been relieved. The cylinder has a discharge opening threaded externally to which is attached an internally threaded discharge pipe, the threading being such that the installer cannot jam the pipe against the piston and thus stop its movement. When the pressure exceeds that for which the spring is designed, the piston compresses the spring and operates an actuator for a microswitch to break the electric circuit to the heating element. A temperature responsive element having an expansible core within the tank is connected to the piston and causes it to compress the spring and operates the actuator of the microswitch to break the electric circuit.

4 Claims, 1 Drawing Figure

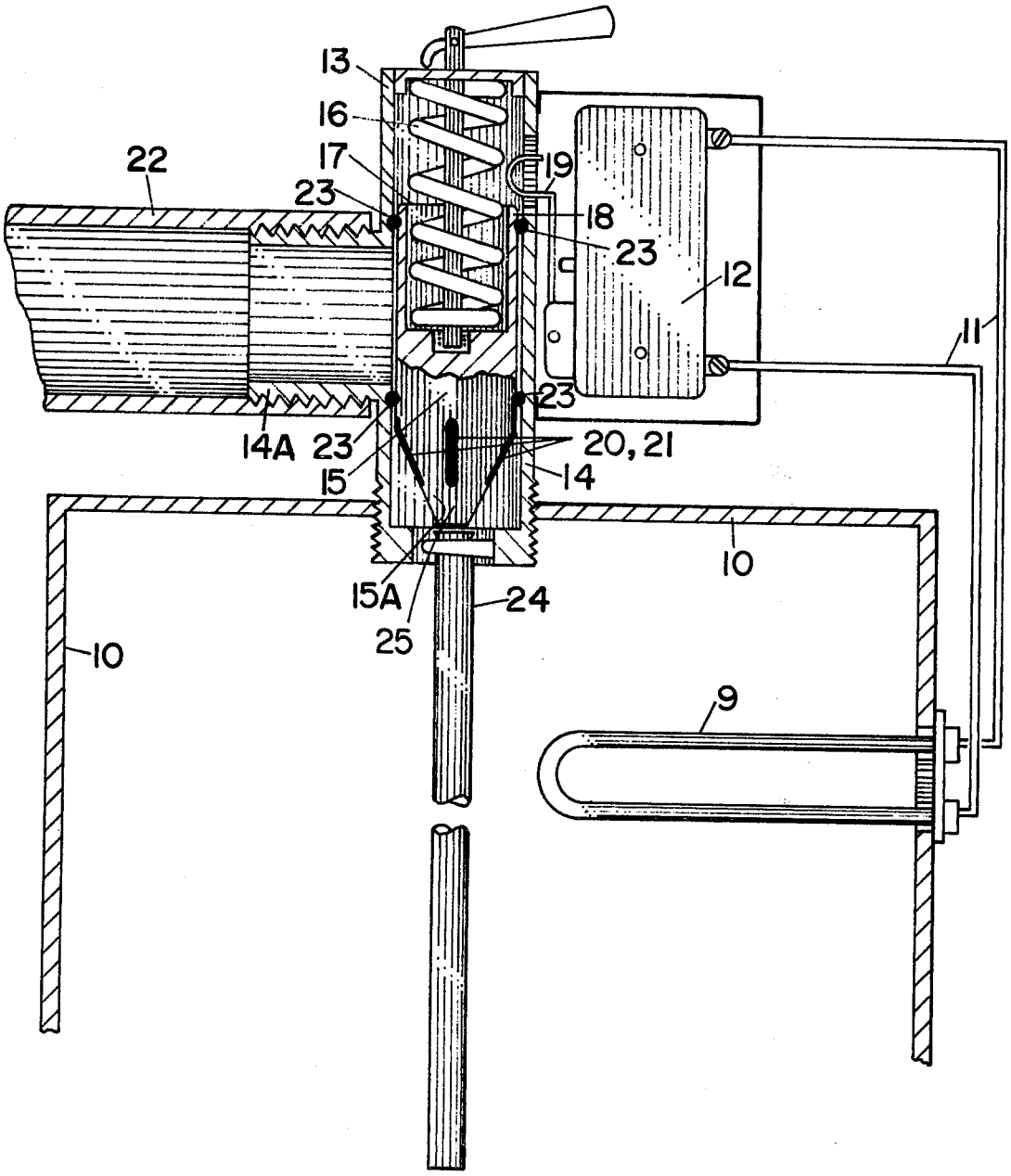
13
16
17
22
23
19
18
23
12
11
23
14A
23
20, 21
15
14
10
15A
24
25
10
9

COMBINATION TEMPERATURE AND PRESSURE RELIEF VALVE WITH ENERGY CUTOFF SWITCH

This application is a continuation-in-part of application Ser. No. 478,901, filed June 13, 1974, now U.S. Pat. No. 3,873,808.

BACKGROUND OF THE INVENTION

The fact that electric water heaters manufactured have quick recovery heating elements installed in them has caused serious problems to the industry.

Safety codes require that at the time of installation a temperature and pressure relief valve be installed on each water heater with a maximum opening pressure of 150 PSI. Since the element heats the water at a very rapid pace, the water will expand rapidly and cause the pressure in the heater to exceed the opening pressure of the relief valve, thus causing the relief valve to discharge hot water. This can be very wasteful and also very dangerous.

SUMMARY OF THE INVENTION

By use of a control made in accordance with the present invention installed in the heater, this cannot happen. When the temperature in the heater causes the pressure to exceed the pressure setting, it will automatically cut off all electricity to the heating elements before fluid is allowed to escape through the relief valve. The control will turn the electricity back on again when the pressure is relieved.

When the pressure in the heater exceeds the setting of the pressure control, due to circumstances other than temperature, it will also automatically cut off all electricity to the heating elements before fluid is allowed to escape through the relief valve and will turn the electricity back on automatically when the pressure in the fluid heater falls below the control setting.

BRIEF DESCRIPTION OF THE DRAWING

The single FIGURE is a cross sectional view partly broken away of one embodiment of a pressure and temperature limiting device made in accordance with this invention with a microswitch to control the electricity to heating elements.

DESCRIPTION OF THE PREFERRED EMBODIMENT

An element 9 for heating a fluid within a tank 10 is connected by an electric circuit 11 to a microswitch 12, mounted upon a support assembly 13. The support assembly is attached to the tank by being inserted through a wall of the tank. The assembly includes a cylinder 14 having a discharge opening 14A and a pressure responsibe piston 15 movable within the cylinder. The lower end 15A of the piston is tapered to a "bullet" shape, i.e., conical or frusto-conical, to get a better discharge of fluid from the tank 10. Also, the taper of the piston's lower end acts as a guide to center the piston back in the opening 20 when the pressure within the tank has been relieved. Movement of the piston is opposed by a stainless steel compression spring 16 which extends into an opening 17 in an open upper end 18 of the piston. The lower end of the piston has the openings 20 and 21 into a discharge pipe 22, as in my prior patent.

Instead of being cylindrical, or circular, in cross section, the cylinder 14 and piston 15 can be rectangular, triangular or of other suitable shape in cross section.

Also, the piston may be coated with a plastic material, such as "TEFLON," to provide a slippery surface on the piston which allows less build-up of chemicals.

When the pressure on the piston is sufficiently great to overcome the resistance of the spring, the piston is moved within the cylinder and its upper end 18 moves against a spring actuator 19 for the microswitch, 12. As the piston continues to move against the actuator, the circuit in the microswitch is broken and the electric current flowing through the leads 11 to the heating element is cut off. When the microswitch is activated the pressure in the tank stabilizes and is then relieved in the normal usage of water in the plumbing system. Should for any reason the micorswitch fail to function, the pressure of the fluid in the tank is then relieved by the escape, instead of suddenly, and thus allows only a "weep" and avoids an abrupt cutting off of the escape of the fluid from the tank. The end of this pipe 22 is threaded internally to be attached to external threads on the discharge opening 14A of the cylinder. This is done so that the installer cannot jam the pipe against the piston and thus stop free movement of the piston. When the pressure within the tank is relieved sufficiently, the spring returns the piston to its normal position. The spring actuator 19 returns to its normal position and the microswitch is returned to its normal position to allow flow again of electricity to the heating element.

Sealing of the fluid within the cylinder is accomplished by a pair of O-rings 23, preferably made of rubber or of some durable plastic material.

When the temperature of the fluid within the tank exceeds a certain limit, a temperature bulb 24 mounted within the tank causes an actuator pin 25 extending within the piston 15 and its openings 20 and 21 into the discharge pipe 22 between the element 24 and the lower end 15A of the piston to push upward against the piston. The bulb 24 contains a material which expands during a rise in its temperature. The pin 25 acts to push against the piston 15 to compress spring 16, thus causing actuator 19 to cut off electricity through the leads 11 to the heating element. In this case, the resetting of the microswitch is accomplished automatically, when the temperature returns to normal.

There are many advantages of this invention, some of these being that a simple and inexpensive device is provided to afford safety in use of a fluid pressure heating device. When the pressure of the fluid within the tank heated by the device exceeds a certain limit, the electricity to a heating element within the tank is cut off, conserving fuel and fluid. At the same time, after the pressure has been relieved, the electricity to the heating element is restored. Also, when the temperature within the tank containing the fluid being heated exceeds a certain maximum, the electricity to the heating element is cut off. In this case, when the temperature of fluid drops back to normal, the electricity to the element is restored automatically. In neither case does any fluid escape through the relief valve.

A device made in accordance with this invention complies with safety codes in effect and guards the user against danger and loss of valuable property.

The present invention is a considerable improvement over that of my allowed application in providing for a faster escape of fluid from the pressure tank and a much more effective guiding of the pressure responsive piston back to its seat in the cylinder opening connected to the tank after the pressure in the tank has been relieved. Also, since the cylinder discharge opening is threaded externally for reception of internal threads on the discharge pipe, it is no longer possible for an inexperienced installer to jam the discharge pipe against the piston and thereby to stop its movement.

It will be apparent to those skilled in the art that various changes may be made in the invention, without departing from the spirit and scope thereof, and therefore the invention is not limited by that which is shown in the drawings and described in the specification, but only as indicated in the appended claims.

I claim:

1. A device for limiting the temperature and pressure of a fluid by controlling the electric current to an element (9) for heating the fluid which comprises a tank (10), a support assembly (13) for the device adapted to be inserted through a wall of the tank, the assembly including a cylinder (14) having a discharge opening (14A), a pressure responsive piston (15) having a somewhat pointed lower end (15A) movable within the cylinder, a compression spring (16) opposing movement of the piston, an actuator (19) extending within the cylinder through the support assembly and adapted to be operated by movement of the piston, a microswitch (12) operable by the actuator to break an electric circuit (11) to the heating element, a discharge pipe (22) having an internally threaded end for attachment to external threads on the discharge opening (14A) of the cylinder, and a temperature responsive element (24) mounted within the tank, the element being connected to the piston to push the piston against the actuator of the microswitch to break the electric circuit to the heating element and a discharge conduit (20) for the overflow of fluid from the cylinder.

2. The device according to claim 1 in which when the temperature within the tank (10) continues to rise for any reason after electricity has been cut off, the piston (15) continues to rise and fluid will be discharged in proportion to excessive temperature.

3. The device according to claim 1 in which when the pressure within the tank (10) exceeds a predetermined setting, the piston (15) in the device moves upward and activates the actuator (19) of the microswitch (12) to cut off electricity to the heating element (9) before fluid is allowed to escape through the relief opening.

4. The device according to claim 1 in which when the microswitch (12) malfunctions the piston (15) continues to rise and fluid will be discharged in proportion to excessive pressure.

* * * * *